US011325132B2

(12) United States Patent
Schmid et al.

(10) Patent No.: US 11,325,132 B2
(45) Date of Patent: May 10, 2022

(54) PROCESSING PLANT

(71) Applicant: Kleemann GmbH, Göppingen (DE)

(72) Inventors: Wolfgang Schmid, Rechberghausen (DE); Christian Weller, Esslingen (DE); Otto Blessing, Bartholomä (DE)

(73) Assignee: Kleemann GmbH

( * ) Notice: Subject to any disclaimer, the term of this patent is extended or adjusted under 35 U.S.C. 154(b) by 0 days.

(21) Appl. No.: 16/971,458

(22) PCT Filed: Jan. 24, 2019

(86) PCT No.: PCT/EP2019/051707
§ 371 (c)(1),
(2) Date: Aug. 20, 2020

(87) PCT Pub. No.: WO2019/174802
PCT Pub. Date: Sep. 19, 2019

(65) Prior Publication Data
US 2021/0031209 A1 Feb. 4, 2021

(30) Foreign Application Priority Data
Mar. 16, 2018 (DE) ..... 10 2018 106 177.3

(51) Int. Cl.
*B02C 23/02* (2006.01)
*B02C 23/10* (2006.01)
*B02C 23/16* (2006.01)
*B02C 21/02* (2006.01)

(52) U.S. Cl.
CPC ..... *B02C 23/02* (2013.01); *B02C 23/10* (2013.01); *B02C 23/16* (2013.01); *B02C 21/026* (2013.01)

(58) Field of Classification Search
CPC ..... B02C 21/00; B02C 21/02; B02C 21/026; B02C 23/02; B02C 23/08; B02C 23/10;
(Continued)

(56) References Cited

U.S. PATENT DOCUMENTS 1,673,465 A * 6/1928 McLaughlin ..... B02C 13/26 241/186.2
2,155,393 A * 4/1939 Battey ..... B02C 4/28 241/285.2

(Continued)

FOREIGN PATENT DOCUMENTS

CA 1042404 A 11/1978

OTHER PUBLICATIONS

Emerson Pillow Block Split Roller Style Bearing (https://www.google.com/search?q=split+pillow+block&source=lnms&tbm=isch&sa=X&ved=2ahUKEwjpzJ2y-dXwAhXDMlkFHaBACTsQ_AUoAnoECAEQBA&biw=1670&bih=792, site accessed May 18, 2021) product cited Jul. 28, 2015, https://web.archive.org/) (Year: 2015).*

(Continued)

*Primary Examiner* — Adam J Eiseman
*Assistant Examiner* — Fred C Hammers
(74) *Attorney, Agent, or Firm* — Lucian Wayne Beavers; Patterson Intellectual Property Law, PC

(57) ABSTRACT

The invention relates to a processing plant, in particular a rock crusher (10), having a filler unit (20,), which can be filled with a material to be crushed, wherein a screening unit (30) is arranged downstream of the filler unit (20) in the conveying direction or in the filler unit (20), which screening unit can be oscillated by means of a vibration exciter (38), wherein the screening unit (30) is used to feed a first part of the supplied material to a process unit, in particular a crusher unit (40) and another part of the supplied material is screened-out in the screening unit (30), wherein a flap (72) of a conveyor unit (70) adjustable about a swivel axis (74.1) is used in a bypass position to feed the screened-out part of the material either onto a conveyor device, in particular a crusher discharge conveyor (60), bypassing the process unit,
(Continued)

in particular the crusher unit (40), or, in a conveying position, to discharge the screened-out part of the material from a working area of the processing plant by means of a conveyor device (50), wherein bearing segments (75.1) of a bearing (75) are coupled to opposite sides of the flap (72), which are rotatably installed on the conveyor unit (70). It is suggested that at least one detachable clamping segment (80.1, 80.2) is assigned to at least one of the bearing segments (75.1), which acts in a clamping manner on the assigned bearing segment (75.1) and secures the latter in a swivel position of the flap (72) relative to the conveyor unit (70), such that in the swivel position the flap (72) is secured against rotation relative to the conveyor unit (70).

18 Claims, 8 Drawing Sheets

(58) Field of Classification Search
CPC ..... B02C 23/16; B07B 1/005; B07B 1/28; B65G 47/22
USPC ..... 241/68; 193/3, 16, 22, 29, 25 R, 25 C; 198/3, 16, 22, 29, 25 R, 25 C, 359, 442, 198/446, 453, 459.6, 530, 533, 537, 540, 198/860.3, 457.07
See application file for complete search history.

(56) References Cited

U.S. PATENT DOCUMENTS

| | | | | | |
|---|---|---|---|---|---|
| 2,317,852 | A * | 4/1943 | Fullerton | B63B 27/16 | 187/272 |
| 2,962,983 | A * | 12/1960 | Ingram | B61D 7/16 | 105/310.1 |
| 3,073,536 | A * | 1/1963 | Quinn | B02C 21/02 | 241/60 |
| 3,620,350 | A * | 11/1971 | Cheek | B65G 65/28 | 198/508 |
| 4,105,544 | A * | 8/1978 | Stevick | B07B 11/06 | 209/246 |
| 2013/0341257 | A1* | 12/2013 | Greve | B07B 1/145 | 209/673 |
| 2014/0061102 | A1* | 3/2014 | Sauser | B07B 13/16 | 209/315 |

OTHER PUBLICATIONS

International Preliminary Report of Patentability for corresponding PCT/EP2019/051707, dated Sep. 22, 2020, 6 pages (not prior art).

* cited by examiner

PROCESSING PLANT

The invention relates to a processing plant, in particular a crusher, in particular a rock crusher for processing natural stone and for recycling demolition materials, having a filler unit, which can be filled with a material to be crushed. A screening unit is arranged downstream of the filler unit in the conveying direction, which screening unit can be oscillated by means of a vibration exciter. The screening unit is used to feed a first part of the supplied material into a crusher unit, and a further part is screened-out in the screening unit. A flap of a conveyor unit adjustable about a swivel axis is used in a bypass position to feed the screened-out part of the material either onto a conveyor device, in particular a crusher discharge conveyor, bypassing the process unit, in particular the crusher unit, or, in a conveying position, to discharge the screened-out part of the material from a working area of the processing plant by means of a conveyor device. On opposite sides of the flap, bearing segments of a bearing are coupled, which bearing segments are rotatably installed on the conveyor unit.

Such crushers are used for crushing rock material and are either mobile or stationary. A filler unit is used to feed the material to be crushed into the plant. Excavators are usually used for this purpose. Starting from the filler unit, a conveyor device is used to convey the material to be crushed to a screening unit. The screening unit can have various designs. Designs are known in which the screening unit forms a simple conveyor chute, which is provided with openings to achieve a screening effect (grate chute). Furthermore, state of the art designs are known, in which a screen deck is used as a circular or elliptical vibration system. There, one or more additional screens are installed below a conveyor chute. A conveyor system is used to feed the rock material to a crusher unit. The crusher unit can be a jaw crusher, for instance. During transport via the upstream unit (grate chute or screen), part of the supplied material is screened out, and this screened-out fraction is routed past the crusher unit in the bypass to prevent it from stressing the crusher. Now, the screened-out fraction can be either discharged via the crusher discharge conveyor, or can be transported out of the working area of the machine using a separate conveyor system. Side belts are usually used for this purpose. The user now has the option of choosing whether to operate in the one or in the other mode. To this end, the user has to set the adjustable flap of the conveyor to either the bypass position or the conveying position.

During operation, it often happens that the screened fine fraction accumulates on the surface of the flap and progressively jams it. This then causes the screened material to no longer be discharged in the desired manner, but to be distributed in the machine in an uncontrolled manner. This problem can be solved, for instance by attaching the flap to the screening unit in such a way that it is excited by the vibration generator in conjunction with the screening unit. During operation, the flap then oscillates in conjunction with the screening unit, which is advantageous in preventing the fine material from accumulating on the surface of the flap.

On the other hand, the flap must be installed on the conveyor unit in an adjustable, in particular between the swivel positions (the bypass position and the conveying position) rotatable, manner. For this purpose, the state of the art is to provide bearing supports on the conveyor unit in which the bearing segments of the flap are rotatably installed. The bearing has a clearance in the range of one or several 1/10 mm. However, due to the vibrations of the flap in conjunction with the screen unit during operation, the bearings may wear out over time. Furthermore, it has proved to be difficult to safely and reliably secure the flap in one of the swivel positions relative to the conveyor unit over a long period of time. In particular, the oscillations and vibrations often cause bolted connections for locking the flap in one of the swivel positions to unbolt.

Based on the described state of the art, the present invention therefore addresses the problem of improving the availability and operational safety of the processing plant, in particular with regard to the adjustable flap oscillating in conjunction with the screening unit.

To solve this problem, it is proposed, based on the processing plant of the type mentioned above, that at least one detachable clamping segment is assigned to at least one of the bearing segments, which acts in a clamping manner on the assigned bearing segment and secures it in a swivel position of the flap relative to the conveyor unit, such that the flap is held secured against rotation in the swivel position relative to the conveyor unit. At least one of the clamping segments assigned to a bearing segment is secured against rotation on the conveyor unit, such that the clamping segment or segments assigned to a bearing segment form a bearing support for the bearing segment. In the case of detached clamping segments, the at least one bearing segment can be rotated therein from one swivel position to the other. If the clamping segment acts in a clamping manner on the at least one bearing segment, the bearing segment is held therein secured against co-rotation by means of frictional locking, such that the flap is secured in the current swivel position about the swivel axis relative to the conveyor unit. The at least one bearing provided with the least one clamping segment then has no bearing clearance and any wear and tear of the bearing during operation of the processing plant is safely and reliably prevented. The clamping of the at least one bearing segment by the at least one releasable clamping segment acts on the bearing segment, preferably in the radial direction from the outside. However, it would also be conceivable that the clamping acts on the bearing segment in a radial direction from the inside. For this purpose, the bearing segment could, for instance have a cylindrical opening on the inside, in which the at least one clamping segment is arranged.

Furthermore, a single clamping segment, e.g. in the form of a clamping ring, can be assigned to a bearing segment, the inner circumference of which can be reduced by means of suitable clamping means, e.g. in the form of at least one bolt, to produce the clamping effect acting on the bearing segment, for the inner circumference of the clamping segment to encompass the outer circumference of the bearing segment in a clamping manner. Preferably, however, one bearing segment is assigned to several clamping segments, preferably two clamping segments, which, for instance, each have the shape of a circular arc and in conjunction form a clamping ring having an adjustable inner circumference. Using suitable clamping means, e.g. in the form of bolts acting between adjacent clamping segments, the inner circumference of the clamping ring can be reduced and the clamping segments can be placed around the outer circumference of the bearing segment in a clamping manner.

The clamping forces of the at least one clamping segment preferably act on the assigned bearing segment in a plane that is perpendicular to the swivel axis of the flap. It has been shown that such a clamping retainer of the flap relative to the conveyor unit is much more insusceptible to oscillations and vibrations than the conventional retainers, e.g. by using solely bolted connections and positive locking.

In accordance with an advantageous further development of the invention, it is proposed that the flap has a section segment, the central axis of which forms the swivel axis of the flap and to the longitudinal ends of which the bearing segments of the bearing are coupled. The section segment may penetrate openings of longitudinal struts forming a support structure for stabilizing and/or bracing the flap. The section segment may be secured to the longitudinal struts, e.g. welded. The bearing segments are welded to the ends of the section segment or secured against rotation thereto in another way.

In accordance with a preferred design variant of the invention, it may be provided that the adjustable conveyor unit has two spaced-apart fastening segments, between which the flap is held in a swiveling manner, wherein the fastening segments are fastened to the screening unit. In particular, it may be provided that the fastening segments are attached to opposite side walls of the screening unit. Passages for the bearing segments of the flap can be formed in the fastening segments.

The fastening segments of the conveyor unit are preferably fastened to opposite side walls of the screening unit by means of flange segments, which are formed on the side walls of the screening unit on the one hand and on the fastening segments on the other hand. To attach the conveyor unit to the screening unit, the corresponding flange segments are simply brought into contact and attached to each other by means of suitable fasteners, e.g. bolts and nuts. Flanging the fastening segments to the side walls of the screening unit facilitates assembly and disassembly or replacement of the conveyor unit.

In accordance with another preferred embodiment, it is suggested that two clamping segments are assigned to the at least one bearing segment, wherein a first clamping segment is attached to the outside of one of the fastening segments and is designed to support the bearing segment. The other clamping segment is arranged on a side of the bearing segment opposite from the first clamping segment and can be detachably attached to the first clamping segment, such that the bearing segment can be secured in a swivel position of the flap relative to the conveyor unit and the flap is secured against rotation relative to the conveyor unit in the swivel position. The clamping segments assigned to a bearing segment are preferably arranged on the outside of the fastening segments so as to be easily reachable by a user from the outside in order to be able to quickly and easily create or release the clamping effect of the clamping segments on the assigned bearing segment. The clamping segments, each assigned to one of the bearing segments, can be attached to each other in any desired detachable manner to encompass the bearing segment arranged therebetween in a clamping manner. For instance, it would be conceivable to fasten the clamping segments to each other by means of bolts such that the bearing segment is clamped between the clamping segments by tightening the bolts to secure the flap against rotation in the swivel position relative to the conveyor unit.

Advantageously the at least one bearing segment has a mainly circular outer circumference and the at least one clamping segment has an arc-shaped inner circumference. The inner circumference of the clamping segments can also comprise several flat segments which, when arranged in a row, form an approximately arc-shaped inner circumference. The same applies to the outer circumference of the bearing segment. In this way, the clamping segment(s) can be attached to large areas of the relevant bearing segment in a clamping manner.

Of course, it would be conceivable to attach and secure the flap in a desired swivel position relative to the conveyor unit in addition to the clamping segments in another way, e.g. by means of a form fit. In this context, provision may be additionally be made that at least one locking segment having at least one locking fitting is attached to the flap in order to hold the flap securely in the respective swivel position on the vibrating screen unit. The at least one locking segment is thereby secured to the flap against rotation. In the bypass position and/or the conveying position, the locking segment or segments can be secured to stationary fastening elements by means of a form fit.

A preferred design of invention is such that the flap has a central area, which angular offsets adjoin laterally on both sides transversely to the conveying direction, and that the screening unit has a conveyor chute, which is formed at least sectionally by a floppy component, for instance a belt made of rubber or plastic, against which the underside of the flap is placed in the bypass position. The floppy component can be used to easily shape the conveyor chute into a tub-like form. The conveyor chute collects the material to be transported in the center of the conveyor chute and feeds it to the flap. The central area and the laterally connected angular offsets of the flap approximately replicate the trough-shaped geometry of the floppy component and in that way makes for an unambiguous discharge of the screened material. Because the flap rests against the underside of the conveyor chute in the bypass position, a descending step results in the transition area between the conveyor chute and the flap in the conveying direction, i.e. there is no resistance to the transport path. This is the simplest way to prevent material from accumulating and jamming.

If it is intended to support the flap using a support structure consisting of longitudinal and transverse struts, a particularly light and stable construction of the flap results.

A particularly preferred design of invention provides that the adjustable conveying unit has a conveying element downstream of the flap in the conveying direction, which connects to the conveying area of the flap in the bypass position of the flap. This results in a space-saving design. In the bypass position, a sufficiently large transport distance can be bridged because of the combination of flap and conveying element. The movement of the flap from the bypass position to the conveying position requires only little room to swivel. If this design also provides for the conveyor element to be attached to the screening unit in such a way that it is excited by the vibration generator in conjunction with the screening unit and the flap, not only the flap but also the conveyor element is reliably protected against being jammed by screened material. To reduce the number of parts and cost and labor of assembly, it may also be provided that the conveying element is attached to the two fastening segments of the conveying unit and keeps them spaced apart from each other.

If it is intended to support the conveying element using a support structure, which is formed of one or several support struts (longitudinal and transverse struts), a particularly light and stable construction of the conveying element results.

It is conceivable that the flap and/or the conveying element have a sheet metal segment, the underside of which is preferably supported by the support structure. Alternatively, it would be conceivable that the flap and/or the conveying element have a material segment made of a floppy material, in particular rubber or plastic, the underside of which is preferably supported by the support structure. The material segment of floppy material has the particular advantage that it can be oscillated particularly strongly and abruptly due to the oscillations and vibrations of the conveying unit and the co-oscillating flap or conveying element, which effectively prevent the fine screenings from accumulating on the surface of the flap or the conveying element. The floppy material segment can rest directly on the support structure or on the sheet metal segment applied thereto. As an alternative to or in addition to the support structure, it is conceivable that at least one bracing element is present in or on the material segment. The bracing element(s) can be used to bring the flap or the conveying element into the desired shape and to maintain this shape. In particular, the support structure and/or the bracing element(s) in the flap or conveying element can be used to shape the central area and the angular offsets adjoining it laterally thereto, such that they emulate the tub-like geometry of the conveyor chute.

A further preferred design of invention provides that the flap and/or the conveying element have a central area laterally adjoined on both sides by angular offsets transverse to the conveying direction, wherein the material segment of a floppy material of the flap or the conveying element is clamped to the outside of the angular offsets along the conveying direction in the manner of a drum covering. This permits the central area of the flap to be oscillated particularly strongly and abruptly, which effectively prevents the fine screenings from accumulating on the surface of the flap or the conveying element.

The invention is explained in greater detail below based on exemplary embodiments shown in the drawings. In the Figures:

FIG. 1 shows a mobile processing plant 10, as it is typically used for crushing rocks or other mineral material. This mobile crusher 10 has a machine chassis supported by two crawler tracks.

Figure 1:
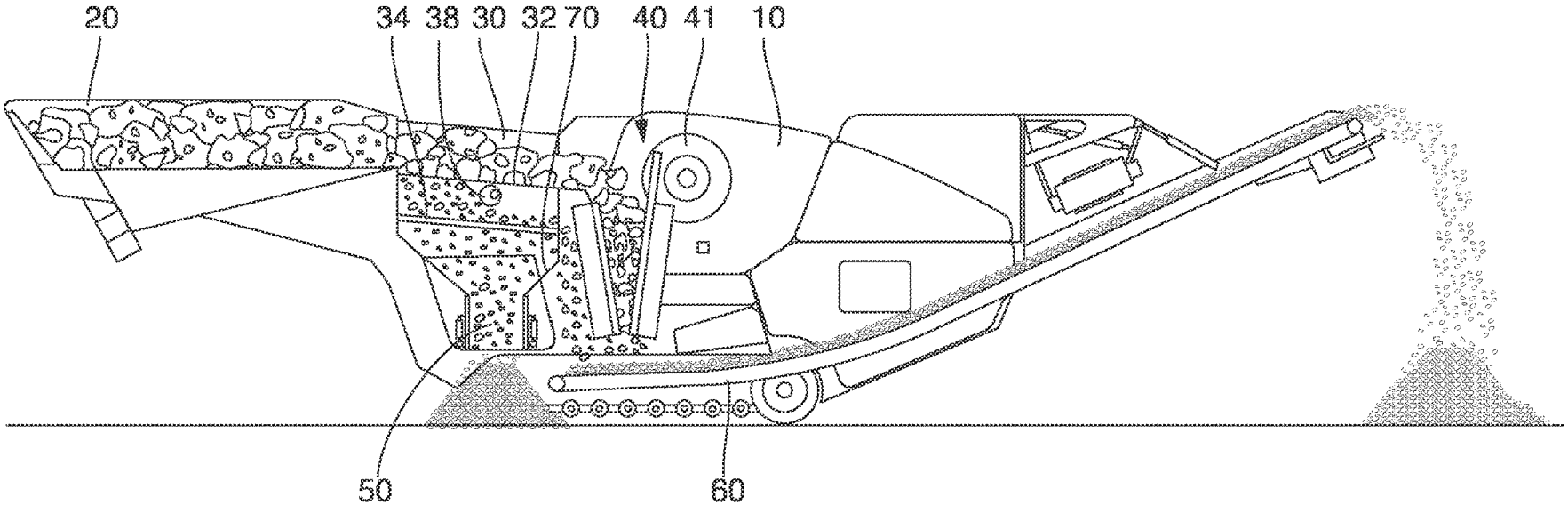
FIG. 1 shows a side view of a schematic diagram of a mobile crusher.

The crusher 10 is equipped with a filler unit 20, which is usually designed as a hopper-shaped feed unit. Filler unit 20 may also be referred to as a hopper 20. This filler unit 20 can be used to fill the crusher 10 with the material to be crushed. The filler unit 20 has a conveyor device at the bottom, especially a grate chute or, as in the present case, a conveyor belt. This conveyor device is used to feed the material to be crushed to a screening unit 30. A vibration exciter 38 is assigned to the screening unit 30, which can be designed as an eccentric drive. This vibration exciter 38 can be used to oscillate the screening unit 30 to subject the material conveyed to a screening process. The vibration exciter 38 not only oscillates the screening unit 30 for screening purposes, but in conjunction with the inclined arrangement of the respective screen decks, achieves a transport effect similar to that of a vibratory conveyor. The screening unit 30 may also be referred to as a vibratory screen 30.

As FIG. 1 shows, the screening unit 30 feeds the coarse rock fraction, which is not screened, to a crusher unit 40. The crusher unit 40 may also be referred to as a crusher 40. The crusher unit 40 is designed to have the shape of a jaw crusher. This crusher unit 40 has two crushing jaws that form a converging gap. The material to be crushed is fed into this gap area. The crusher unit 40 has a stationary crushing jaw and a movable crushing jaw. An eccentric drive 41 drives the movable crushing jaw. As FIG. 1 shows, the coarse rock material is crushed in the converging gap. On the bottom side, the crushed and broken rock material exits the crusher unit 40 and falls onto a crusher discharge conveyor 60 due to gravity. The crusher discharge conveyor 60 is designed as an endlessly circulating conveyor belt. The crusher discharge conveyor 60 discharges the crushed rock material and piles it up next to the crusher 10.

As the drawing shows, the material coming from the filler unit 20 is passed through a screen 32 (e.g. top screen deck) in the screening unit 30. In the process, part of the rock material is singled out. These are pieces of rock which, due to their size, do not have to be sent through crusher unit 40, as they already have a size that corresponds approximately to the rock size that results from crushing by the crusher unit 40. As the drawing shows, a part of this singled-out rock fraction is fed directly to the crusher discharge conveyor 60 in a bypass past the crusher unit 40. Now there is another screen deck 34 in the screen unit 30 below the screen 32. This screen deck 34 screens a further, fine partial fraction from the material already screened. It is now partly desired to separate this particularly fine partial fraction, for which a discharge belt 50 is used. The discharge belt 50 may be referred to as a fines discharge conveyor 50. The fine partial fraction is fed onto this endlessly rotating discharge belt 50, is conveyed out of the working area of crusher 10 and piled, as shown in FIG. 1. Now, discharging the fine sub-fraction is not always desired. Rather, the machine operator wants to have the choice of feeding it separately from or conjointly with the coarser screened material directly onto the crusher discharge conveyor 60. An adjustable conveyor unit 70 is used for this purpose. The adjustable conveyor unit 70 may also be referred to as an adjustable conveyor 70.

Figure 2:
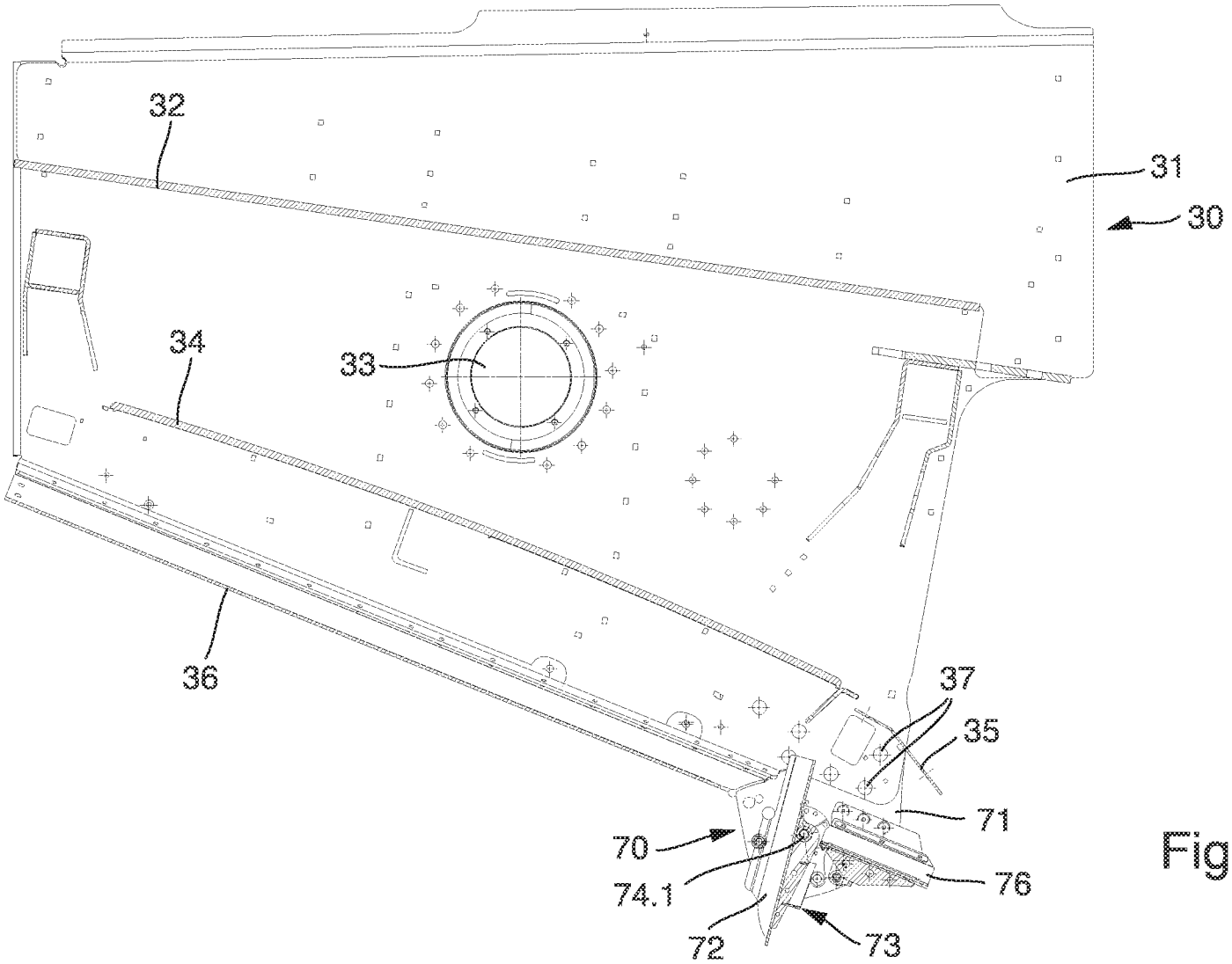
FIG. 2 shows a side view and a sectional view of a screen unit of a crusher.

The design, arrangement and function of the conveyor unit 70 is described in more detail below. As FIG. 2 shows, the screening unit 30 has two side walls 31, which are spaced apart from each other. The conveying area for the rock material is formed between the two side walls 31. The illustration shows that at least one of the side walls 31 has a holder 33 for the vibration exciter 38. It can be used introduce the vibration energy of the vibration exciter 38 into the side wall 31. A different arrangement of the vibration exciter 38 is also conceivable, wherein it should be provided, however, that the vibration energy from the vibration exciter 38 is introduced into the screening unit 30 such that the screening unit 30 vibrates with the frequency and amplitude of the vibration exciter 38.

The screen 32 is held in the upper part of the screening unit 30 between the two side walls 31. The screen deck 34 is situated below the screen 32. There is a conveying area between the screen 32 and the screen deck 34. A conveying area is defined above the screen 32 by means of the two side walls 31 and the screen 32. There is a further conveying area below the screen deck 34. A conveyor chute 36 delimits this conveying area at the bottom. The conveyor chute 36 can be designed as a floppy component, e.g. made of rubber or plastic, wherein the conveyor chute 36 extends lengthwise from the left side of the screen unit 30 up to the adjustable conveyor unit 70. As further illustrated in FIG. 2, the screen deck 34 can be extended by a discharge surface 35. In this case, the discharge surface 35 is connected to the screen deck 34 in the conveying direction in the form of a descending step to prevent a barrier from forming in the conveying direction.

Figure 3:
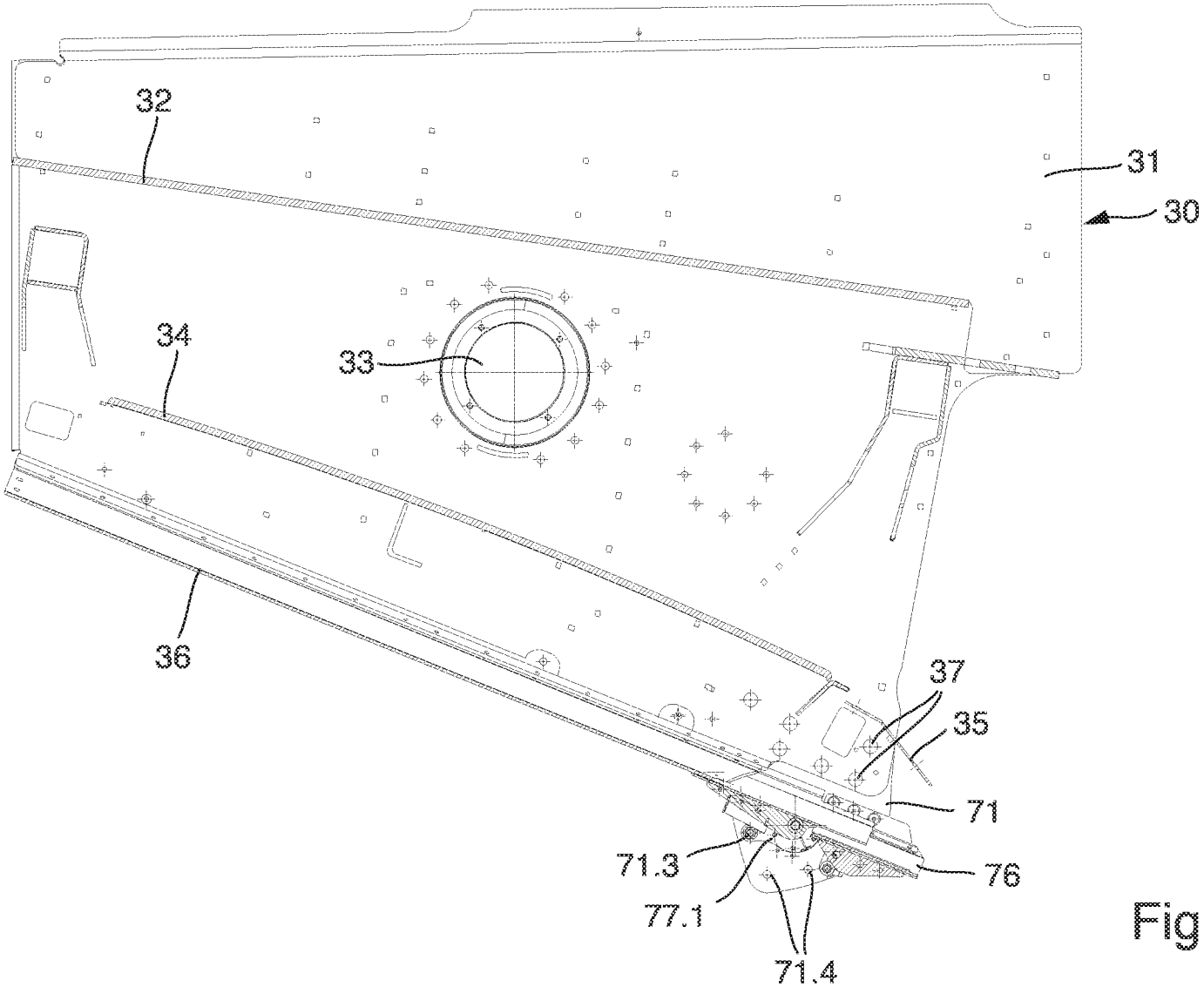
FIG. 3 shows the representation according to FIG. 2 in a different operating position.

The adjustable conveying unit 70 has a flap 72 and a conveying element 76. The flap 72 can be swiveled about a swivel axis 74.1. FIG. 2 shows an operating position in which the flap 72 is in a swiveled conveying position. In this position, the fine fraction screened out by the screen deck 34 is fed to the discharge conveyor 50 via the flap 72. FIG. 3 shows another operating position of the flap 72, which represents the bypass position. In this swivel position, the screened fine rock material coming from the conveyor 36 is fed to the conveyor element 76 via the flap 72. The fine rock material then falls from the conveyor element 76 onto the crusher discharge conveyor 60.

As FIGS. 2 and 3 further show, the side walls 31 have bolt holes 37 in the area of the adjustable conveyor unit 70. These are used to fasten the adjustable conveyor unit 70 to the side walls 31 by means of fastening bolts 71.6. In this way, the adjustable conveyor unit 70 can be attached to the screening unit 30. The conveyor unit 70 is preferably flanged to the screening unit 30 using flange segments, as explained in more detail below.

The structure of the adjustable conveyor unit 70 can be seen more clearly from the illustrations in FIGS. 4 to 10. As these drawings show, the adjustable conveyor unit 70 has two lateral mounting segments 71, which can be designed as sheet metal segments. The mounting segments 71 may also be referred to as first and second mounting brackets 71. Both the flap 72 and the conveyor element 76 are located between the two securing segments 71. In the example shown, the conveyor unit 70 is flanged to the screening unit 30. For this purpose, flange segments 71.7, 71.8 are formed on the opposite side walls 31 of the screening unit 30 and on the fastening segments 71 of the conveyor unit 70. The flange segments 71.7, 71.8 are shown in detail in FIGS. 5 and 6. The fastening segments 71 are each formed in bipartite, wherein a first part of a fastening segment 71, on which a first flange segment 71.7 is formed, is secured to one of the side walls 31 by means of the securing bolts 71.6, and a second part of the fastening segment 71, on which a second flange segment 71.8 is formed, has a lead-through 71.2 for a bearing segment 75.1 of the flap 72, as explained in detail below. To secure the adjustable conveyor unit 70, its flange segments 71.8 are simply held against the flange segments 71.7 from below, which flange segments are assigned to the opposite side walls 31, and the flange segments 71.7, 71.8 are attached to each other by means of fastening bolts 71.9 and matching nuts 71.10. Flanging the conveyor unit 70 to the screening unit 30 facilitates the assembly and disassembly or permits a very easy replacement of the conveyor unit 70.

The flap 72 can be formed from a sheet metal segment 72.4 as a punched and bent part. It has a central area 72.1, to which angular offsets 72.2 are connected on both sides. Facing away from the central area 72.1, the angular offsets 72.2 have chamfers 72.3. The laterally positioned angular offsets 72.2 and the central area 72.1 are used to simulate a trough-shaped geometry of the conveyor chute 36. The support structure 73 is situated below the flap 72. This support structure 73 has interconnected longitudinal struts 73.1 and cross struts 73.2, 73.3. The support structure 73 underpins the flap 72, providing a stable lightweight construction in this way. A material segment 72.5 made of a floppy material, e.g. in the form of a sheeting made of rubber or plastic, can rest at least sectionally on the sheet metal segment 72.4 of the central area 72.1 and the angular offsets 72.2 on both sides. This embodiment is shown in FIGS. 5 and 7 to 10, for instance. The material segment 72.5 can be clamped on the outer sides of the chamfers 72.3 in the manner of a drum covering, such that the material segment 72.5, in particular in the central area 72.1 and in the area of the angular offsets 72.2, can be oscillated particularly strongly when the conveying unit 70 vibrates in conjunction with the screening unit 30 in order to prevent the material conveyed thereon from agglomerating and accumulating. In an alternative embodiment, however, it is also conceivable that the material segment 72.5 is made of the floppy material instead of the sheet metal segment 72.4 and rests directly on the support structure 73 of the flap 72. In this case, too, the material segment 72.5 is clamped and held externally at the chamfers 72.3 and only rests on the support structure 73 in the central area 72.1 and in the area of the angular offsets 72.2.

As an alternative to or in addition to the support structure 73, it is conceivable that at least one bracing element (not shown) is present in or on the material segment 72.5. The bracing element(s) can be made of plastic or metal, for instance. The bracing element(s) can be used to bring the flap 72 into the desired shape and to maintain this shape. In particular, the support structure 73 and/or the bracing element(s) at the flap 72 can be used to shape the central area 72.1 and the angular offsets 72.2 laterally adjoining the latter, such that they simulate the tub-like geometry of the conveyor chute 36.

Figure 5:
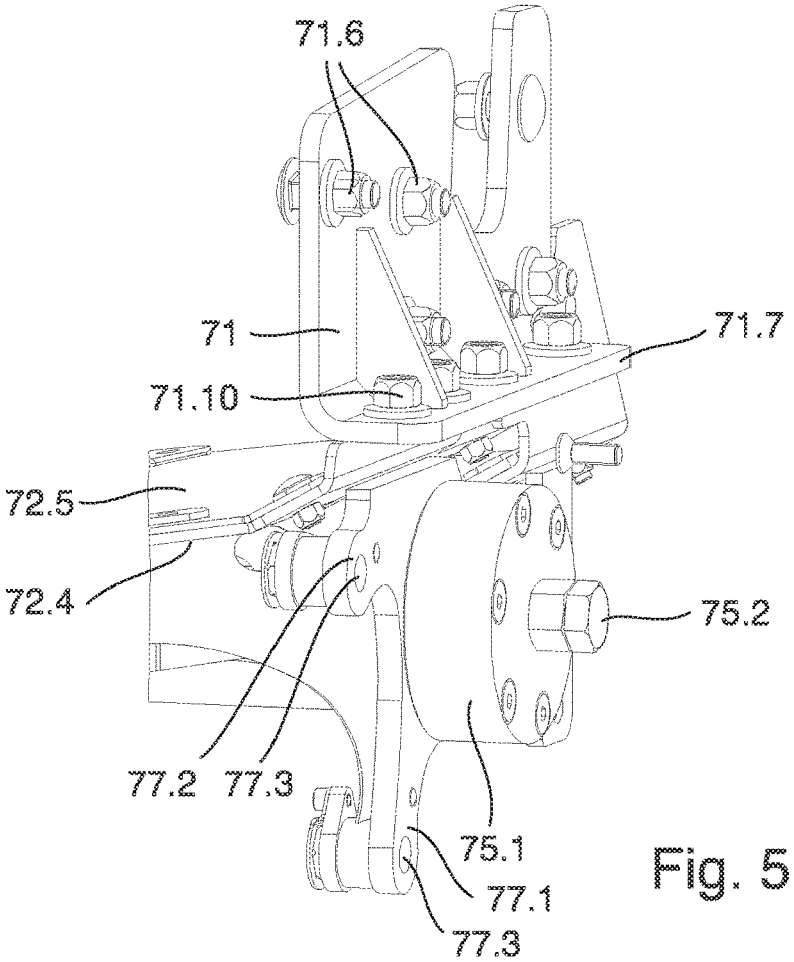
FIGS. 5 and 6 show a bearing of the adjustable conveyor unit as shown in FIG. 4.

The longitudinal struts 73.1 may have openings through which a section segment 74 extends. The section segment 74 may also be referred to as an axle 74. The section segment 74 may be secured to the longitudinal struts 73.1, e.g. welded. The central line of the section segment 74 forms the swivel axis 74.1 of the flap 72. At its longitudinal ends, bearing segments 75.1 of a bearing 75 are attached to the section segment 74, as shown in FIG. 5. The bearing segments 75.1 can be formed by circular disks, as shown. The bearing segments 75.1 may also be referred to as rotatable bearings 75.1. The bearing segments 75.1 are welded to the ends of the section segment 74 or secured thereto against rotation in another way. Locking segments 77.1, 77.2 having locking fittings 77.3 may be attached either to bearing segments 75.1 or to the support structure 73 or to the flap 72. The locking segments 77.1, 77.2 may also be referred to as locking elements 77.1, 77.2. The locking segments 77.1, 77.2 are secured to the flap 72 against rotation. The bearing segments 75.1 extend through the fastening segments 71 via lead-throughs 72.1 resulting in them being arranged on the outside of the fastening segments 71. The lead-throughs 72.1, for instance are designed, as in this case, as circular cut-outs from the fastening segments 71 (see FIG. 6). The allocation of the bearing segments 75.1 to the fastening segments 71 is performed using clamping segments 80.1, 80.2. The bearing segments 75.1 can be inserted into these clamping segments 80.1, 80.2. to form a pivot bearing. The clamping segment 80.1 may be referred to as a fixed clamping segment 80.1 and the clamping segment 80.2 may be referred to as a detachable clamping segment 80.2.

In the examples shown, two clamping segments 80.1, 80.2 are assigned to each of the bearing segments 75.1. However, it is also possible to assign clamp segments to only one of the bearing segments 75.1, or to assign only one clamp segment to each bearing segment 75.1, which then encompasses a larger circumference of bearing segments 75.1 than shown in FIG. 6. Bolts 80.3 and nuts 80.4 are used to hold the clamping segments 80.1, 80.2 together. If the bolts 80.3 or nuts 80.4 are loosened so far that the clamping segments 80.1, 80.2 are held together, but their inner circumference does not clamp against the outer circumference of the bearing segments 75.1, the clamping segments 80.1, 80.2 are in a so-called bearing position and form bearing supports for the bearing segments 75.1. In the bearing position of the clamping segments 80.1, 80.2, the flap 72 can be turned about the swivel axis 74.1 into one of the swivel positions. By tightening the bolts 80.3 or the nuts 80.4, the clamping segments 80.1, 80.2 reach a retaining position, in which an inner circumference formed by the clamping segments 80.1, 80.2 is reduced such that the clamping segments 80.1, 80.2 have a clamping effect on the bearing segments 75.1 and secure the flap 72 in the swivel position relative to the conveyor unit 70. The clamping segments 80.1, 80.2 thus form bearing supports having an adjustable bearing clearance. In particular, the bearing clearance in the retaining position can be reduced to a minimum, such that any wear and tear of the bearings 75 during the operation of the crusher 10 is for all intents and purposes impossible.

In order to prevent any undesired adjustment of the flap 72 in the individual swivel position, an additional retaining device can be provided for the flap 72. The additional retaining device is achieved, for instance by using positioning elements 71.5, which are engaged with the locking fittings 77.3 in the individual swivel position. Particularly advantageously, provision may be made to design the positioning elements 71.5 as securing bolts, which are inserted through bolt holes 71.3, 71.4 of the fastening segments 71 and which are bolted into the locking fittings 77.3 designed as threaded fittings. In particular, one or more, preferably two, positioning elements 71.5 per swivel position may be provided to ensure the assignment of the flap 72 to the fastening segments 71.

Figure 6:
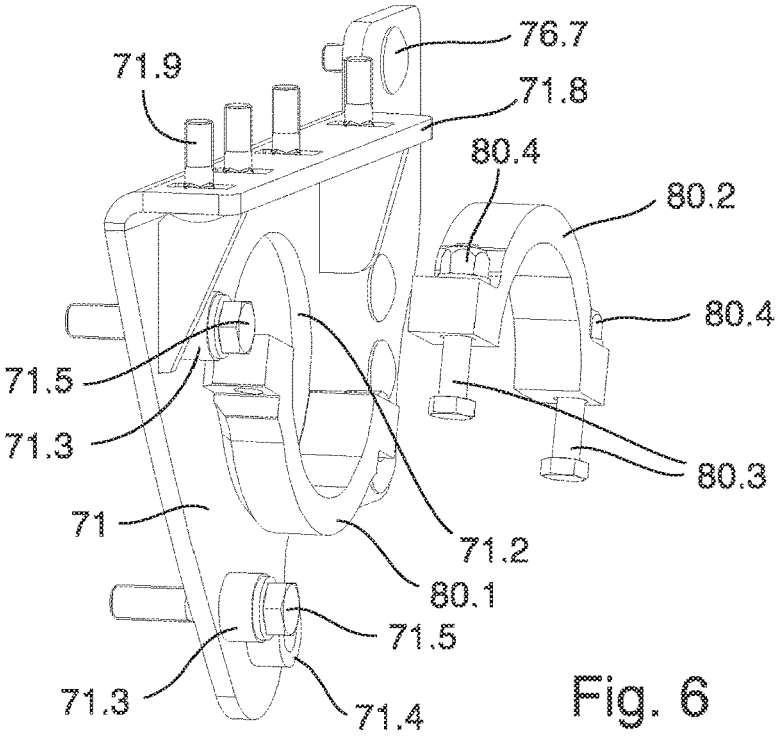

In an embodiment of the invention shown in FIGS. 5 and 6, the bearing segments 75.1 can be secured by means of the detachable clamping segments 80.1, 80.2 in a swivel position of the flap 72 relative to the conveyor unit 70 or the fastening segments 71, such that the flap 72 is secured against rotation in the swivel position relative to the conveyor unit 70. In this case, an additional retainer of the bearing segments 75.1 to the locking fittings 77.3 and the positioning elements 71.5 by means of the locking segments 77.1, 77.2 can be dispensed with. It is proposed in particular that each of the bearing segments 75.1 be assigned two clamping segments 80.1, 80.2, wherein a first clamping segment 80.1 of a bearing 75 is fastened to one of the fastening segments 71 and is designed to hold the bearing segment 75.1, and the other clamping segment 80.2 is arranged on a side of the bearing segment 75.1 opposite from the first clamping segment 80.1 and can be detachably fastened to the first clamping segment 75.1, such that the bearing segment 75.1 can be clamped between the two clamping segments 80.1, 80.2 in their retaining positions. In this way, the bearing segment 75.1 can be secured in a swivel position of the flap 72 relative to the conveyor unit 70 and in the swivel position the flap 72 is secured against rotation relative to the conveyor unit 70. This clamping retainer of the flap 72 relative to the fastening segments 71 has proved to be particularly suitable for the large vibrations that occur during the operation of crusher 10.

The first clamping segment 80.1 is attached to the fastening segment 71, e.g. by welding. The second clamping segment 80.2 can be detachably fastened to the first clamping segment 80.1, for instance by means of bolts 80.3. The bolts 80.3 can penetrate matching openings in the clamping segments 80.1, 80.2 and be secured using the nuts 80.4. By tightening the bolts 80.3 or the nuts 80.4, a distance between the clamping segments 80.1, 80.2 can be reduced in the manner of brackets or clamps. In this way the bearing segments 75.1 can be clamped between the clamping segments 80.1, 80.2. It is particularly preferred if the bearing segments 75.1 have an essentially circular outer circumference and the clamping segments 80.1, 80.2 each have an arc-shaped inner circumference. The inner circumference of the clamping segments 80.1, 80.2 can also comprise several flat segments which, when arranged in a row, form an approximately arc-shaped inner circumference. In this way, the clamping segments 80.1, 80.2 can rest on the bearing segments 75.1 over a large area.

As FIGS. 4, 5 and 7 to 10 show, at least one of the bearing segments 75.1 has an actuating element 75.2 which is secured against rotation at the bearing segment 75.1 and thus to the flap 72. The actuating element 75.2 may be formed by a hex head. The actuating element 75.2 can be accessed with a tool. The tool can be used to adjust the actuating element 75.2 and therewith the flap 72 to swivel it between the bypass position and the conveying position. The bypass position may be referred to as a first position of the flap 72 and the conveying position may be referred to as a second position of the flap 72.

Figure 4:
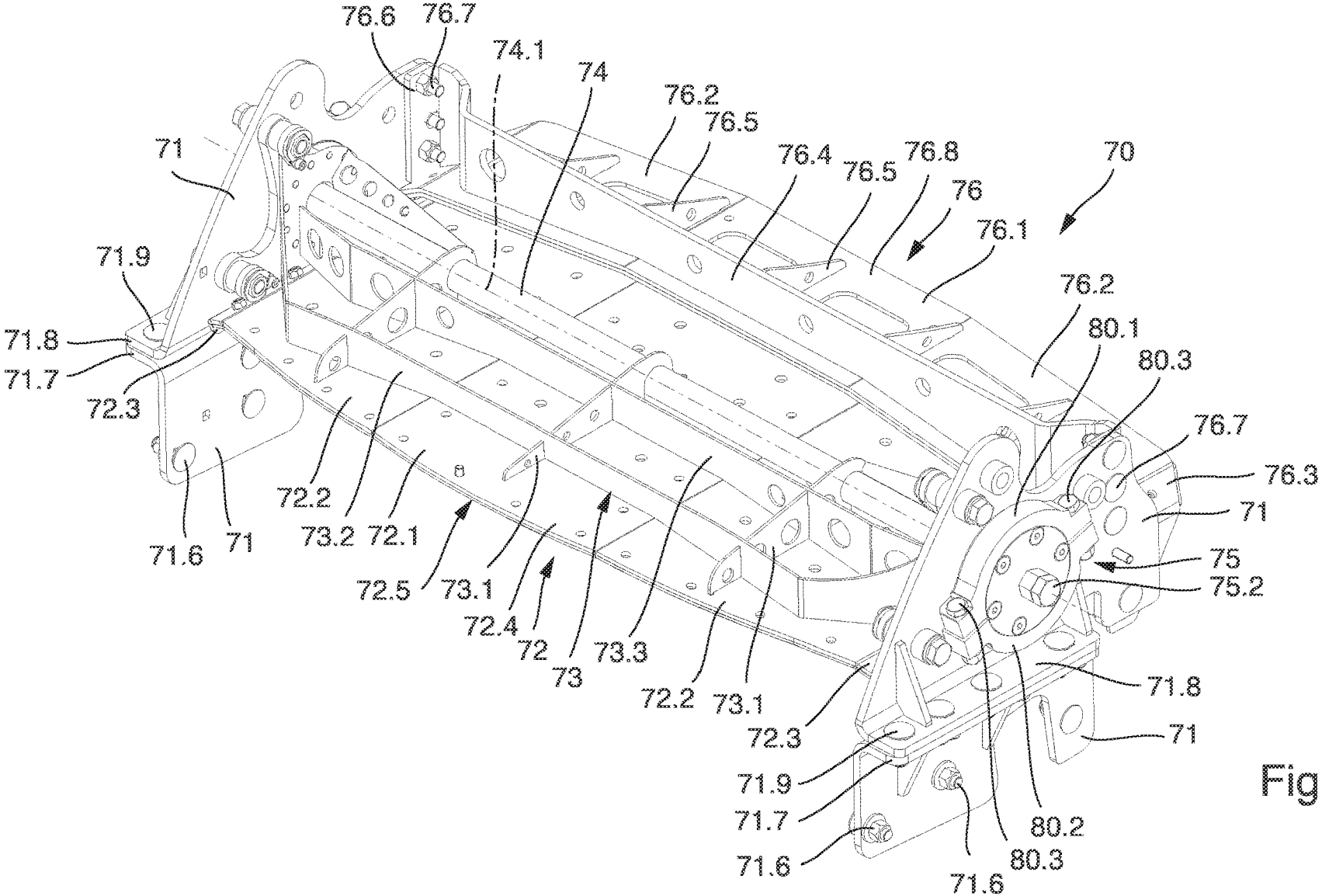
FIG. 4 shows a bottom view of an adjustable conveyor unit in perspective view.

The conveyor element 76 is also attached to the two mounting segments 71. The conveyor element 76 can be made of a sheet metal segment 76.8 as a punched and bent part. The sheet metal segment 76.8 may also be referred to as a sheet metal element 76.8. It has a central area 76.1, to which angular offsets 76.2 are connected on both sides. Facing away from the central area 76.1, chamfers 76.3 are bent away from the angular offsets 76.2. The chamfers 76.3 have attachment points 76.6, as shown in FIG. 4. Using suitable fastening elements, for instance bolts 76.7, the conveyor element 76 can then be connected to the fastening segments 71. The conveyor element 76 is therefore used to secure the two fastening segments 71 at the desired distance from each other. The central area 76.1 and the two angular offsets 76.2 of the conveying element 76 emulate the trough-shaped geometry of the flap 72 or the conveyor chute 36.

Figure 9:
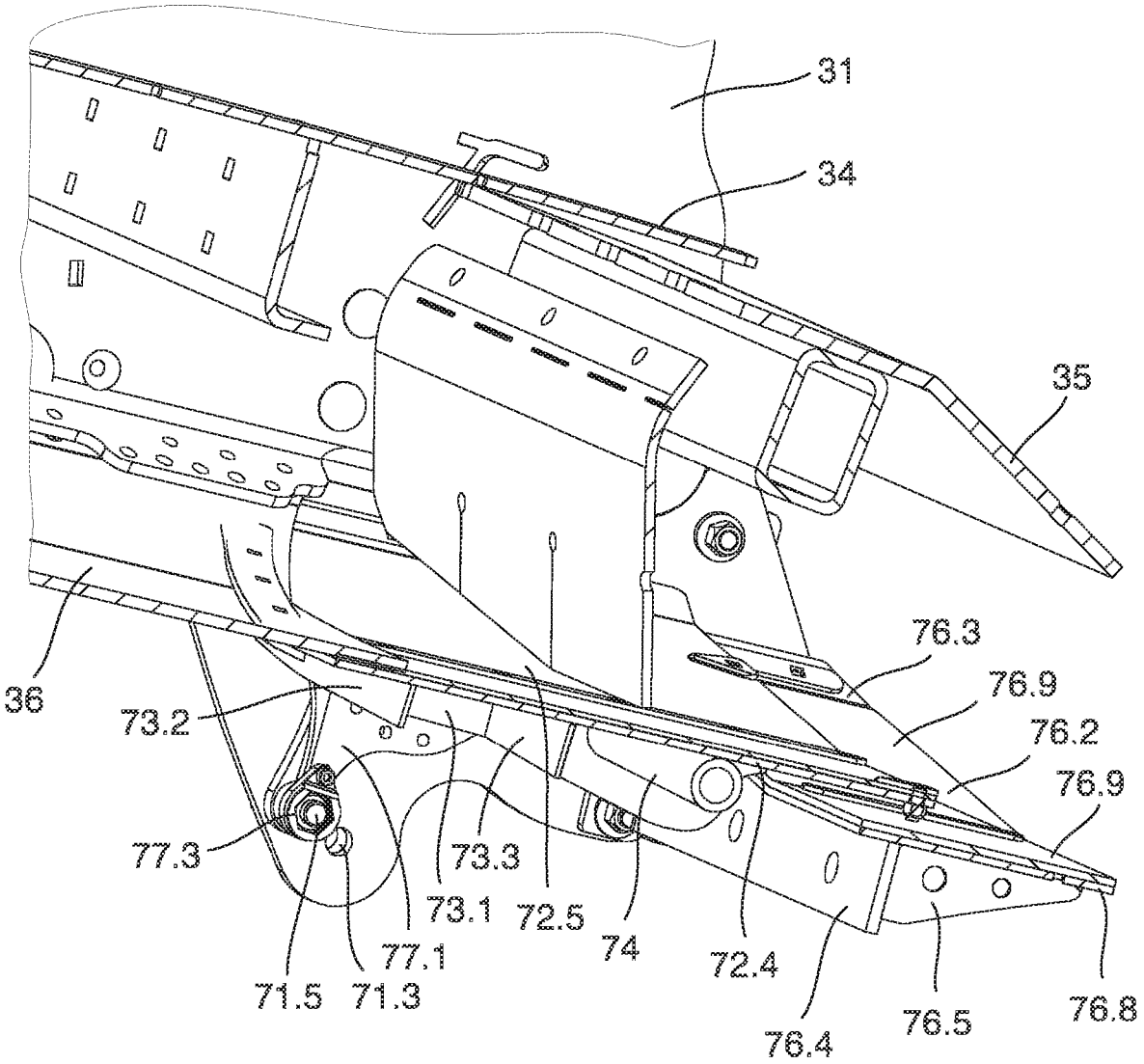
FIG. 9 shows a longitudinal section of the conveyor unit in accordance with FIGS. 4, 7 and 8.
Figure 10:
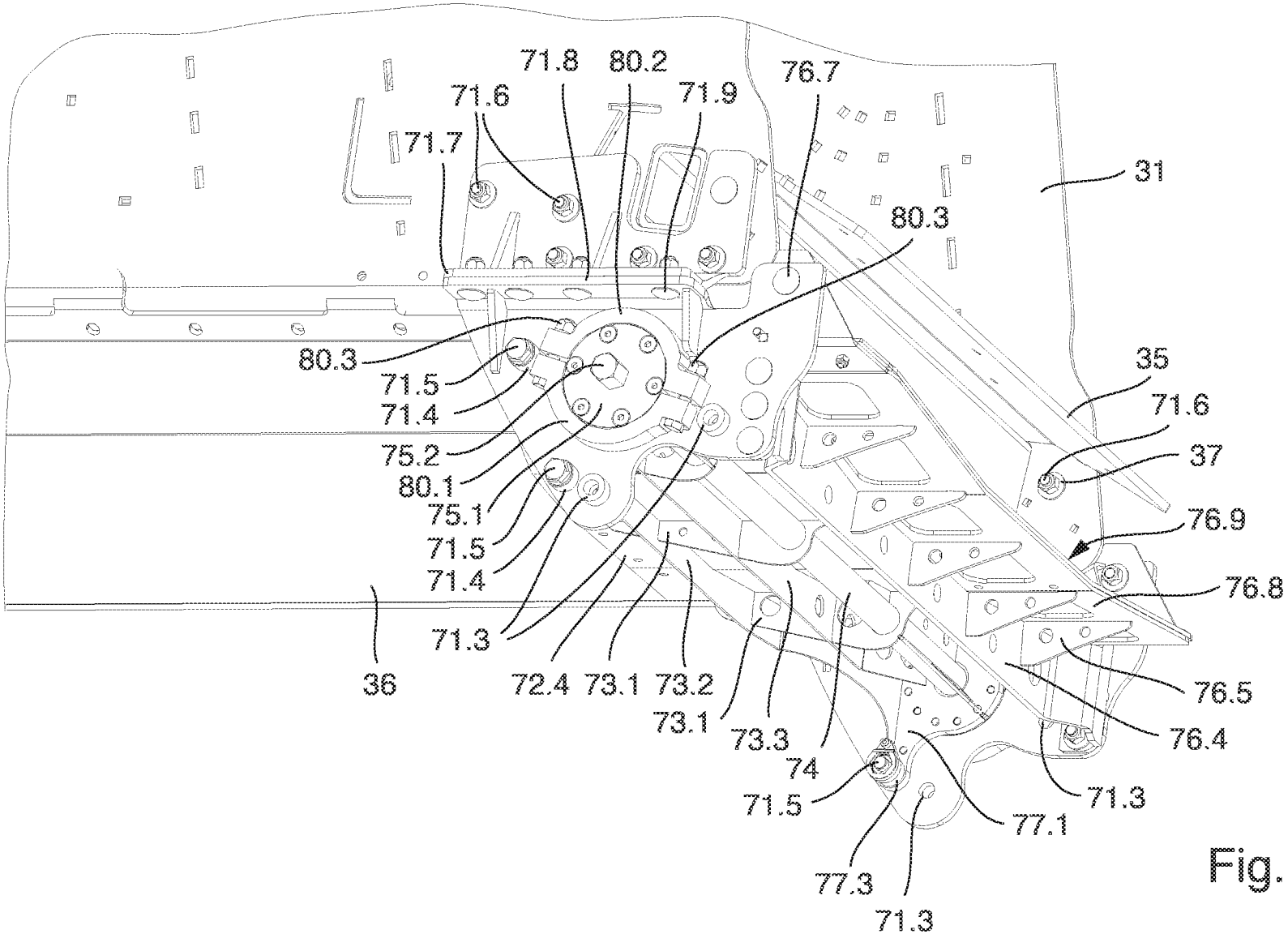
FIG. 10 shows a bottom view of the conveyor unit in accordance with FIGS. 4, 7 and 8 in perspective view.

FIGS. 4, 9 and 10 further illustrate the structure of the conveying element 76. As this illustration shows, at least one support strut 76.4 and longitudinal struts 76.5 are attached to the underside of the conveyor element 76. These struts 76.4, 76.5 form a support structure for the conveyor element 76, which makes for a stable lightweight design. The support strut 76.4 has angled fastening segments 76.6 at its longitudinal ends as attachment points. The bolts 76.7 can be inserted through these fastening segments 76.6 to connect the support strut 76.4 to the fastening segments 71. Accordingly, the support strut 76.4 is then used on the one hand as a stable support for the conveyor element 76 and on the other hand to keep the fastening segments 71 at a defined distance from each other.

A material segment 76.9 made of a floppy material, e.g. having the form of a sheeting made of rubber or plastic, can rest at least sectionally on the sheet segment 76.8 of the central area 76.1 and the angular offsets 76.2 on both sides. The material segment 76.9 may also be referred to as a material element 76.9. This embodiment is shown in FIGS. 9 and 10, for instance. The material segment 76.9 can be clamped on the outer sides of the chamfers 76.3 in the manner of a drum covering, such that the material segment 76.9, in particular in the central area 76.1 and in the area of the angular offsets 76.2, can be oscillated particularly strongly when the conveying unit 70 vibrates in conjunction with the screening unit 30 in order to prevent the material conveyed thereon from agglomerating and accumulating. In an alternative embodiment, however, it is also conceivable that the material segment 76.9 is made of the floppy material instead of the sheet metal segment 76.8 and rests directly on the support structure 76.4, 76.5 of the conveyor element 76. In this case, too, the sheeting 76.9 is clamped and held externally at the chamfers 76.3 and only rests on the support structure 76.4, 76.5 in the central area 76.1 and in the area of the angular offsets 76.2.

As an alternative to or in addition to the support structure 76.4, 76.5, it is further conceivable that at least one bracing element (not shown) is present in or on the material segment 76.9. The bracing element(s) can be made of plastic or metal, for instance. The bracing element(s) can be used to bring the conveyor element 76 into the desired shape and to maintain this shape. In particular, the support structure 76.4, 76.5 and/or the bracing element(s) at the conveyor element 76 can be used to shape the central area 76.1 and the angular offsets 76.2 laterally adjoining the latter, such that they emulate the trough-like geometry of the flap 72 and/or the conveyor chute 36.

The adjustable conveyor unit 70 shown in FIGS. 4 to 10 including its flap 72 and the conveyor element 76 can be manufactured as a pre-assembled unit. It can then be easily installed on the screening unit 30. The assembly is particularly easy if it is provided that the two fastening segments 71—as described above—are connected to the side walls 31 of the screening unit 30 by means of the flange segments 71.7, 71.8. For this purpose it may be provided that the first parts of the fastening segments 71 have bolt holes. These can be aligned with the bolt holes 37 of the side walls 31. The fastening bolts 71.6, which then penetrate through the bolt holes 37, can be used to establish a secure and stable fastening of the first parts of the fastening segments 71 of the adjustable conveyor unit 70 on the side walls 31 of the screening unit 30. Alternatively, it would also be conceivable that the flange segments 71.7 are welded to the outside of the side walls 31 or fastened in some other way.

The mode of operation of the adjustable conveyor unit 70 is explained in more detail below. FIGS. 3, 4, 7, 9 and 10 show the bypass position as explained in more detail above. The top of flap 72 rests against the bottom of the conveyor chute 36. Due to the angled geometry of the flap 72, the flap 72 emulates the curved shape of the conveyor chute 36. In this way a smooth material transport is rendered possible. This is also supported by the flap 72 resting against the underside of the conveyor chute 36. In this way, a descending step is formed in the conveying direction.

Figures 7, 8:
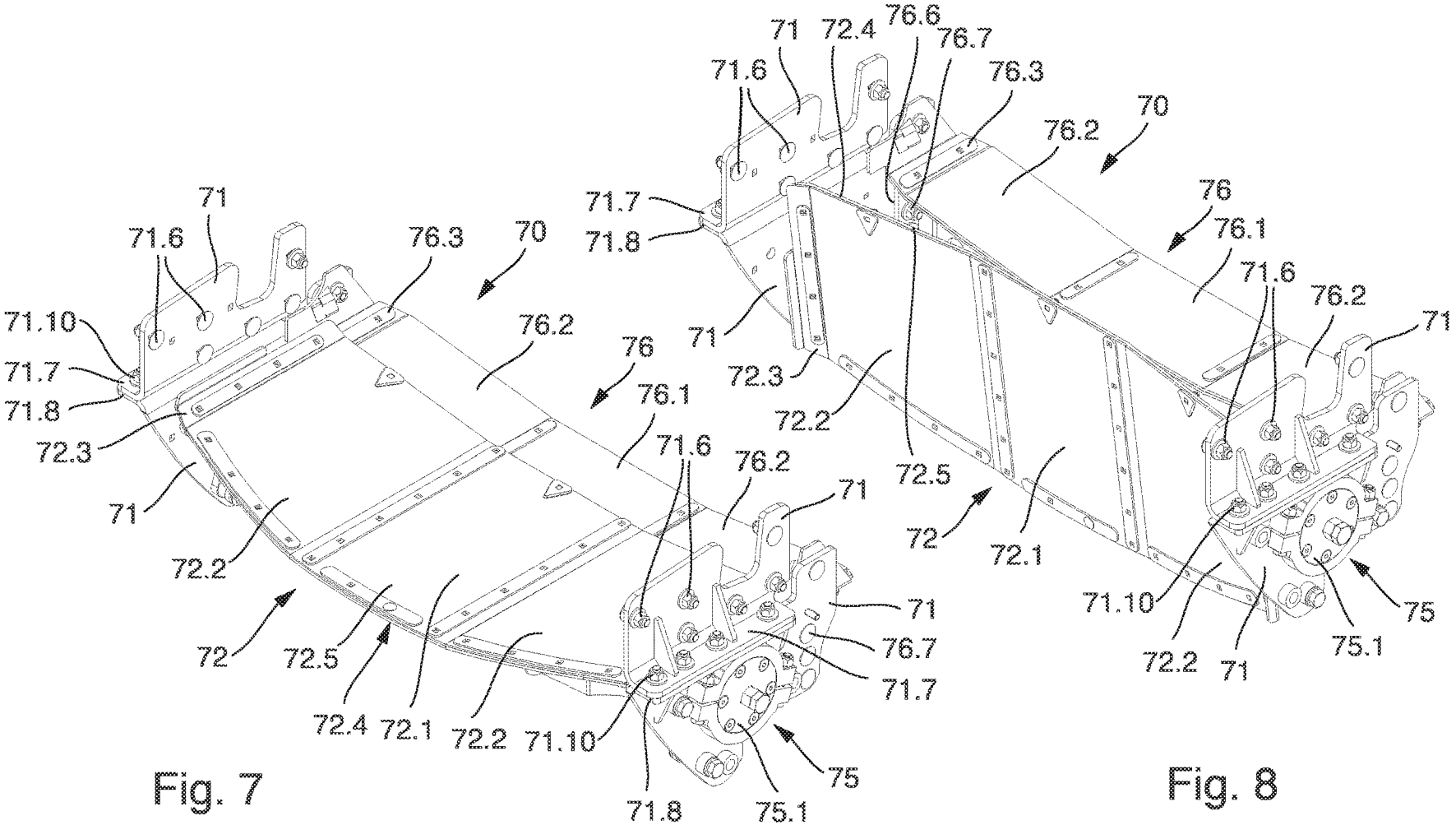
FIG. 7 shows a top view of the adjustable conveyor unit according to FIG. 4 in perspective view.
FIG. 8 shows the adjustable conveyor unit of FIG. 7, but in a different operating position

In the bypass position, the end of the flap 72 facing away from the conveyor chute 36 is placed above the conveyor element 76, as shown in FIGS. 3, 7 and 9. In this way, a descending step is also formed in the conveying direction, preventing jamming from occurring. If the flap 72 is now to be turned from the bypass position shown in FIG. 3 to the conveying position (see FIGS. 2 and 8), the anti-rotation lock on the flap 72 must be released. To this end, the positioning elements 71.5, designed as securing bolts, are unbolted from the locking fittings 77.3, designed as threaded fittings, and removed from the bolt holes 71.3, 71.4 of the fastening segments 71. In addition, the connection between the clamping segments 80.1, 80.2 is unbolted to release the clamping support of the bearing segments 75.1. Then a suitable tool is engaged with the actuating element 75.2. The flap 72 can then be turned until it reaches the swivel position shown in FIGS. 2 and 8. In doing so, the loosened clamping segments 80.1, 80.2 are used as bearing supports. Then the conveying path between the conveyor chute 36 and the conveyor element 76 is interrupted. The material flow coming from the conveyor chute 36 is now routed directly to the discharge belt 50. The flap 72 blocks the path between the conveyor chute 36 and the conveying element 76 and for this purpose also protrudes a bit beyond these components. This reliably prevents material from entering the area of the crusher discharge conveyor 60. In this new swivel position, the flap 72 can again be secured against unintentional swiveling by means of the clamping segments 80.1, 80.2 or additional retaining devices, e.g. in the form of the positioning elements 71.5.

The invention claimed is:

1. A rock crusher plant, comprising:

a hopper configured to be filled with a material to be crushed;

a vibratory screen arranged to receive the material from the hopper, the vibratory screen being configured to feed a first part of the material to a crusher and to pass a second part of the material through a screen of the vibratory screen;

an adjustable conveyor including a flap rotatable about a swivel axis between a first position wherein the second part of the material is conveyed onto a crusher discharge conveyor, and a second position wherein the second part of the material is conveyed onto a fines discharge conveyor; and wherein the adjustable conveyor further includes first and second rotatable bearings coupled to opposite sides of the flap, and at least one releasable clamping segment configured to be movable from a bearing position to a retaining position by tightening a fastener, wherein an associated one of the bearings is rotatable relative to the at least one releasable clamping segment in the bearing position and wherein the associated one of the bearings is restrained against rotation by the at least one releasable clamping segment in the retaining position such that the flap is secured against rotation between the first and second positions.

2. The rock crusher plant of claim 1, wherein:

the flap includes an axle having a central axis forming the swivel axis, and the first and second bearings are attached to longitudinal ends of the axle.

3. The rock crusher plant of claim 1, wherein:

the adjustable conveyor includes first and second mounting brackets spaced apart from one another and fastened to the vibratory screen, the first and second mounting brackets including first and second passages for the first and second bearings, respectively, such that the flap is held in a swiveling manner about the swiveling axis between the first and second mounting brackets.

4. The rock crusher plant of claim 3, wherein:

the first and second mounting brackets each include a flange configured to be attached to a further flange attached to a side wall of the vibratory screen.

5. The rock crusher plant of claim 3, wherein:

the adjustable conveyor further includes a fixed clamping segment fastened to an associated one of the mounting brackets and configured to hold the associated one of the bearings, the at least one releasable clamping segment being arranged on a side of the associated one of the bearings opposite from the fixed clamping segment, the at least one releasable clamping segment being releasably fastened to the fixed clamping segment such that the associated one of the bearings can be secured such that the flap is secured against rotation between the first and second positions.

6. A rock crusher plant, comprising:

a hopper configured to be filled with a material to be crushed;

a vibratory screen arranged to receive the material from the hopper, the vibratory screen being configured to feed a first part of the material to a crusher and to pass a second part of the material through a screen of the vibratory screen;

an adjustable conveyor including a flap rotatable about a swivel axis between a first position wherein the second part of the material is conveyed onto a crusher discharge conveyor, and a second position wherein the second part of the material is conveyed onto a fines discharge conveyor; and wherein the adjustable conveyor further includes first and second rotatable bearings coupled to opposite sides of the flap, and at least one releasable clamping segment configured to clamp an associated one of the bearings and secure the one of the bearings such that the flap is secured against rotation between the first and second positions;

wherein the adjustable conveyor includes first and second mounting brackets spaced apart from one another and fastened to the vibratory screen, the first and second mounting brackets including first and second passages for the first and second bearings, respectively, such that the flap is held in a swiveling manner about the swiveling axis between the first and second mounting brackets;

wherein the adjustable conveyor further includes a fixed clamping segment fastened to an associated one of the mounting brackets and configured to hold the associated one of the bearings, the at least one releasable clamping segment being arranged on a side of the associated one of the bearings opposite from the fixed clamping segment, the at least one releasable clamping segment being releasably fastened to the fixed clamping segment such that the associated one of the bearings can be secured such that the flap is secured against rotation between the first and second positions; and wherein the fixed clamping segment and the at least one releasable clamping segment are fastened to one another by bolts, and the associated one of the bearings is restrained between the fixed clamping segment and the at least one releasable clamping segment by tightening the bolts such that the flap is secured against rotation between the first and second positions.

7. The rock crusher plant of claim 1, wherein:

the associated one of the bearings has a largely circular outer circumference and the at least one releasable clamping segment has an arc-shaped inner circumference.

8. The rock crusher plant of claim 1, wherein:

the vibratory screen includes a conveyor chute formed at least partially by a floppy component; and the flap includes a central area and angular offsets adjoining the central area and extending from opposite sides of the central area transversely to a conveying direction, the flap including an underside placed against the floppy component of the vibratory screen when the flap is in the first position.

9. The rock crusher plant of claim 1, wherein:

the flap includes a support structure including at least one transverse strut and at least one longitudinal strut.

10. The rock crusher plant of claim 9, wherein:

the flap includes a sheet-metal element and the support structure is attached to an underside of the sheet-metal element.

11. The rock crusher plant of claim 10, wherein:

the flap includes a material element made of a floppy material, and an underside of the floppy material is underpinned by the sheet-metal element.

12. The rock crusher plant of claim 9, wherein:

the flap includes a material element made of a floppy material, and an underside of the floppy material is underpinned by the support structure.

13. A rock crusher plant, comprising:

a hopper configured to be filled with a material to be crushed;

a vibratory screen arranged to receive the material from the hopper, the vibratory screen being configured to feed a first part of the material to a crusher and to pass a second part of the material through a screen of the vibratory screen;

an adjustable conveyor including a flap rotatable about a swivel axis between a first position wherein the second part of the material is conveyed onto a crusher discharge conveyor, and a second position wherein the second part of the material is conveyed onto a fines discharge conveyor;

wherein the adjustable conveyor further includes first and second rotatable bearings coupled to opposite sides of the flap, and at least one releasable clamping segment configured to clamp an associated one of the bearings and secure the one of the bearings such that the flap is secured against rotation between the first and second positions; and wherein the adjustable conveyor includes a conveying element downstream of the flap in a conveying direction, the conveying element being configured to connect to a conveying area of the flap when the flap is in the first position.

14. The rock crusher plant of claim 13, wherein:

the conveying element includes a support structure including at least one transverse strut and at least one longitudinal strut.

15. The rock crusher plant of claim 14, wherein:

the conveying element includes a sheet-metal element and the support structure is attached to an underside of the sheet-metal element.

16. The rock crusher plant of claim 15, wherein:

the conveying element includes a material element made of a floppy material, and an underside of the floppy material is underpinned by the sheet-metal element.

17. The rock crusher plant of claim 14, wherein:

the conveying element includes a material element made of a floppy material, and an underside of the floppy material is underpinned by the support structure.

18. The rock crusher plant of claim 1, wherein:

the flap includes one or more locking elements having at least one locking fitting configured to be secured to a stationary fastening element in the first and second positions.

* * * * *